US006071099A

United States Patent [19]

Noboru et al.

[11] Patent Number: 6,071,099

[45] **Date of Patent: *Jun. 6, 2000**

[54] SCROLL COMPRESSOR HAVING A DISCHARGE MUFFLER

[75] Inventors: Yoshinori Noboru; Yasunori Kiyokawa; Katsuki Tsuchiya; Hideki Wadayama, all of Gunma-ken, Japan

[73] Assignee: Sanyo Electric Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/853,679

[22] Filed: May 9, 1997

[30] Foreign Application Priority Data

May 10, 1996 [JP] Japan ..... 8-116654

[51] Int. Cl.[7] ..... F04C 18/04; F04C 29/06

[52] U.S. Cl. ..... 418/55.1; 418/181

[58] Field of Search ..... 418/55.1, 55.5, 418/181

[56] References Cited

U.S. PATENT DOCUMENTS

| | | | |
|---|---|---|---|
| 5,141,420 | 8/1992 | Nambiar | 418/55.1 |
| 5,330,463 | 7/1994 | Hirano | 418/55.5 |
| 5,667,371 | 9/1997 | Prenger et al. | 418/55.1 |

FOREIGN PATENT DOCUMENTS

| | | | |
|---|---|---|---|
| 63-268992 | 11/1988 | Japan . | |
| 63-309790 | 12/1988 | Japan | 418/55.5 |
| 1-032093 | 2/1989 | Japan . | |
| 6432093 | 2/1989 | Japan | 418/55.1 |
| 4241702 | 8/1992 | Japan | 418/55.1 |
| 6307356 | 11/1994 | Japan | 418/55.1 |
| 7-027063 | 1/1995 | Japan . | |
| 63-239931 | 10/1998 | Japan . | |
| 2 194 291 | 3/1998 | United Kingdom . | |

*Primary Examiner*—John J. Vrablik
*Attorney, Agent, or Firm*—Darby & Darby

[57] ABSTRACT

A high-performance scroll compressor permits the prevention of the deformation of an end plate of a fixed scroll in a hermetically sealed vessel of a typical wall thickness and strength, thus obviating the need for increasing the wall thickness of the vessel or employing a material of higher strength to enhance the pressure resistance of the vessel. A partition is provided between the rear surface of the fixed scroll and the hermetically sealed vessel, and a hole of the partition is communicated with a discharge hole in the end plate of the fixed scroll. A covering member is mounted on the partition to form a muffler, and a discharge pipe is attached to the muffler.

5 Claims, 4 Drawing Sheets

SCROLL COMPRESSOR HAVING A DISCHARGE MUFFLER

BACKGROUND OF THE INVENTION

1. Field of the Invention

The present invention relates to a scroll compressor which performs compression by making use of the engagement between a fixed scroll and a rocking scroll.

2. Description of Related Art

A typical conventional scroll compressor is constituted by a scroll compression element and an electric element which are housed in a low or high internal pressure type hermetically sealed vessel. The scroll compression element is equipped with: a fixed scroll which has an end plate provided with a spiral wrap composed of an involute curve on the surface thereof; a rocking scroll which has an end plate provided with a spiral wrap composed of an involute curve on the surface thereof and which is opposed to and engaged with the fixed scroll; driving means for turning the rocking scroll in relation to the fixed scroll so that a plurality of compression spaces formed by the rocking scroll and the fixed scroll gradually become smaller from outside toward inside, thereby implementing compression; and coupling means for revolving the rocking scroll in relation to the fixed scroll in such a manner that the rocking scroll does not rotate.

There has been available a low internal pressure type in which a partition is provided between the rear surface of the fixed scroll and the hermetically sealed vessel, and a hole in the partition is communicated with a discharge hole in the end plate of the fixed scroll by a sealing member (refer to Japanese Examined Utility Model Publication No. 7-10075).

The configuration disclosed in the foregoing publication is designed to prevent the high pressure gas emitted through the discharge hole of the fixed scroll from being applied to the end plate of the fixed scroll so as to protect the end plate of the fixed scroll from deformation.

According to the aforesaid configuration, however, the discharge space of the high pressure gas is formed by the partition and the hermetically sealed vessel; therefore, the hermetically sealed vessel must have a considerably higher pressure resistance than an average one to ensure safety. This requires an increased wall thickness of the vessel and the use of a material of higher strength, posing a problem of an increased weight and higher cost.

SUMMARY OF THE INVENTION

The present invention has been accomplished with a view toward solving the problem described above, and it is an object of the invention to provide a high-performance scroll compressor which permits the prevention of the deformation of an end plate of a fixed scroll in a hermetically sealed vessel which has typical wall thickness and strength, thus obviating the need for increasing the wall thickness of the hermetically sealed vessel or employing a material of higher strength to enhance the pressure resistance of the vessel.

To this end, according to the present invention, there is provided a scroll compressor constituted by a scroll compression element and an electric element which are housed in a low internal pressure type hermetically sealed vessel. The scroll compression element is equipped with: a fixed scroll which has an end plate provided with a spiral wrap composed of an involute curve on the surface thereof; a rocking scroll which has an end plate provided with a spiral wrap composed of an involute curve on the surface thereof and which is opposed to and engaged with the fixed scroll; driving means for turning the rocking scroll in relation to the fixed scroll so that a plurality of compression spaces formed by the rocking scroll and the fixed scroll gradually become smaller toward inside from outside, thereby implementing compression; and coupling means for revolving the rocking scroll in relation to the fixed scroll in such a manner that the rocking scroll does not rotate; a partition being provided between the rear surface of the fixed scroll and the hermetically sealed vessel, and a hole in the partition being communicated with a discharge hole in the end plate of the fixed scroll; wherein a covering member is mounted on the partition to form a muffler to which a discharge pipe is attached.

The foregoing partition is fixed to the hermetically sealed vessel by shrink fitting, press fitting, or welding.

Alternatively, the partition is fixed with a bolt or other fastener to the fixed scroll or the main frame supporting the fixed scroll.

DESCRIPTION OF THE PREFERRED EMBODIMENTS

Figure 1:
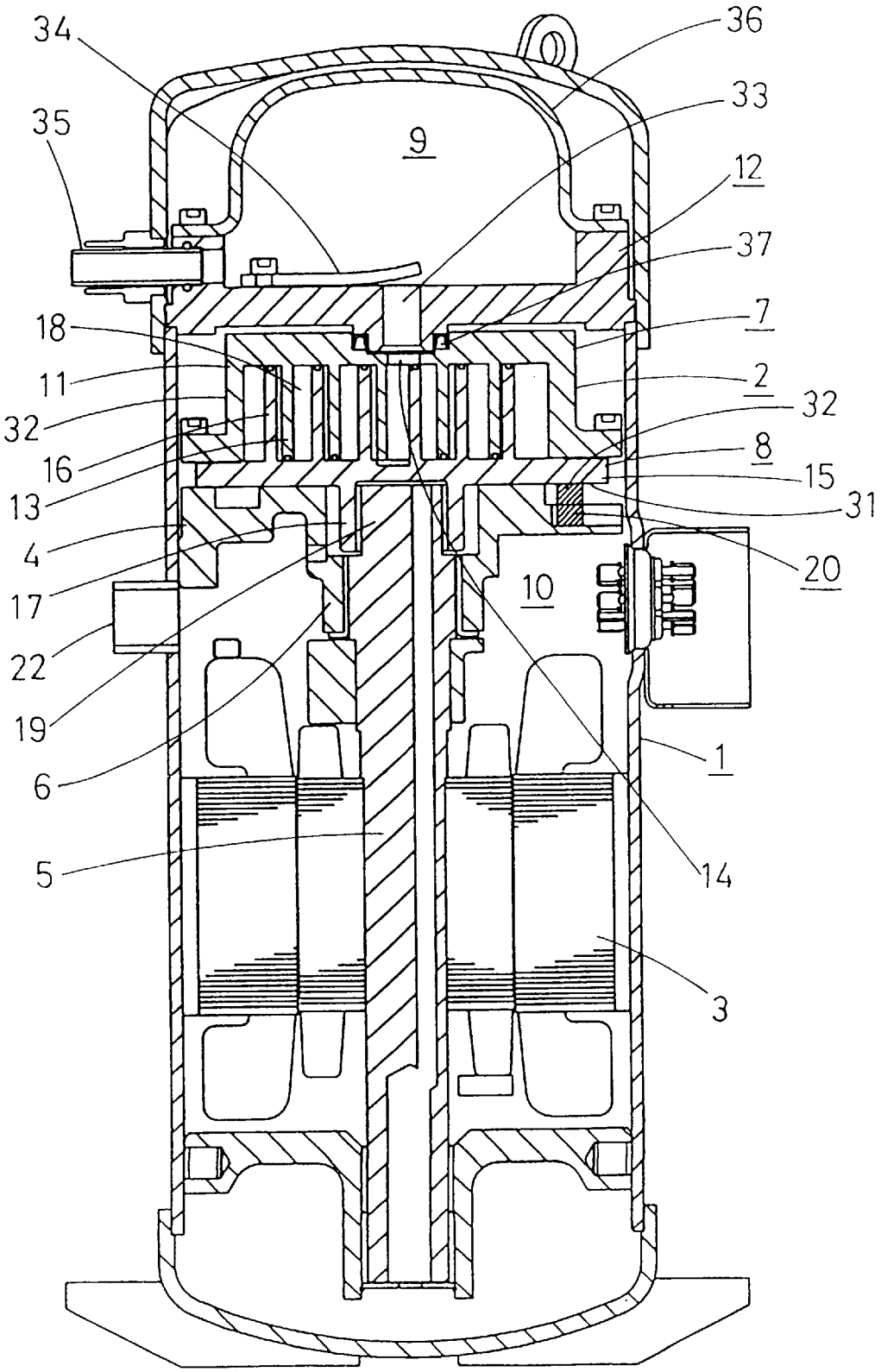
FIG. 1 is a sectional view of a scroll compressor illustrating an embodiment of the present invention.

The present invention will be described in conjunction with an embodiment shown in FIG. 1.

Provided on the upper side in a low internal pressure type hermetically sealed vessel 1 is a scroll compression element 2 and provided on the lower side therein is an electric element 3 for driving the compression element. A frame 4 is provided with a bearing 6 which journals a rotary shaft 5 at the center thereof. The scroll compression element 2 is constituted by a fixed scroll 7 and a rocking scroll 8.

The fixed scroll 7 is secured to the frame 4 by a bolt. The fixed scroll 7 is comprised of a discoid end plate 11, an annular wall 32 jutting out to one surface periphery of the end plate 11, and a spiral wrap 13 which is surrounded by the annular wall 32 and provided on the end plate 11, the spiral wrap 13 being composed of an involute curve or a curve similar to the involute curve.

A partition 12 provided between the hermetically sealed vessel 1 and the fixed scroll 7 is equipped with a discharge hole 33, a discharge valve 34 which opens or closes the discharge hole 33, a discharge pipe 35 for releasing discharged gas out, and a covering member 36 which forms a discharge muffler chamber 9 inside thereof.

The partition 12 is fixed to the hermetically sealed vessel 1 by shrink fitting or press fitting.

Thus, the interior of the hermetically sealed vessel 1 is divided into the high pressure muffler chamber 9 and a low pressure chamber 10.

The end plate 11 of the fixed scroll 7 is equipped with a discharge hole 14 which is communicated with the muffler chamber 9 in the hermetically sealed vessel 1. The discharge hole 14 is communicated with the discharge hole 33 of the partition 12 via a sealing member 37. The direction in which the annular wall 12 and the wrap 13 project indicates the bottom side of the fixed scroll 7.

The rocking scroll 8 is comprised of a discoid end plate 15, a spiral wrap 16 which is provided on one surface of the end plate 15 and which is composed of an involute curve or a curve similar to the involute curve, and a bearing boss 17 which juts out at the center of the other surface of the end plate 15. The direction in which the wrap 16 projects indicates the top side of the rocking scroll 8. The wrap 16 is turned 180 degrees and opposed to and meshed with the wrap 13 of the fixed scroll 7 so as to form a plurality of compression spaces 18.

An eccentric section 19 provided at a distal end of the rotary shaft 5 fits in the bearing boss 17 of the rocking scroll 8; the center of the eccentric section 19 is provided eccentrically with respect to the axial center of the rotary shaft 5. An Oldham's coupling 20 has a pair of keys 32, 32 which engage with a pair of keyways 31, 31 of the rocking scroll 8; it revolves the rocking scroll 8 on a circular orbit with respect to the fixed scroll 7 in such a manner that the rocking scroll 8 does not rotate.

A suction pipe 22 attached to the hermetically sealed vessel 1 is communicated with the low pressure chamber 10 in the hermetically sealed vessel 1 at above the electric element 3.

In the scroll compressor thus configured, when the electric element 3 is turned, the torque is transmitted to the rocking scroll 8 via the rotary shaft 5.

Specifically, the rocking scroll 8 is driven by the bearing boss 17, which has been inserted in the eccentric section 19 of the rotary shaft 5 eccentrically with respect to the axial center of the rotary shaft 5, and it is revolved on the circular orbit by the Oldham's coupling 20 in relation to the fixed scroll 7 such that it does not rotate. The fixed scroll 7 and the rocking scroll 8 gradually narrow the compression spaces 18 formed thereby from outside toward inside, thus compressing a refrigerant which flows out of the suction pipe 22 into the low pressure chamber 10 in the hermetically sealed vessel 1. The compressed refrigerant is discharged into the muffler chamber 9 through the discharge hole 14 of the fixed scroll 7 and the discharge hole 33 of the partition 12; then it is ejected out of the hermetically sealed vessel 1 through the discharge pipe 35.

Oil retained at the bottom of the hermetically sealed vessel 1 is moved up in an oilhole of the rotary shaft 5 by the centrifugal pump action of the rotary shaft 5 and it reaches the bearing boss 17 of the rocking scroll 8 to lubricate the sliding section of the bearing boss.

Since the covering member 36 is attached to the partition 12 to form the high pressure muffler chamber 9 and the discharge pipe 35 is attached to the muffler chamber 9, the high pressure muffler chamber 9 can be isolated from the fixed scroll 7. This makes it possible to prevent the deformation of the end plate 11 of the fixed scroll 7 while enabling the muffler chamber 9 to display the muffling effect at the same time.

Further, the hermetically sealed vessel 1 is subjected only to the low pressure of intake gas; therefore, the strength required of the vessel 1 is easily attainable. This means that the wall thickness of the vessel 1 can be made thin and a general material can be employed for the vessel 1.

Figure 2:
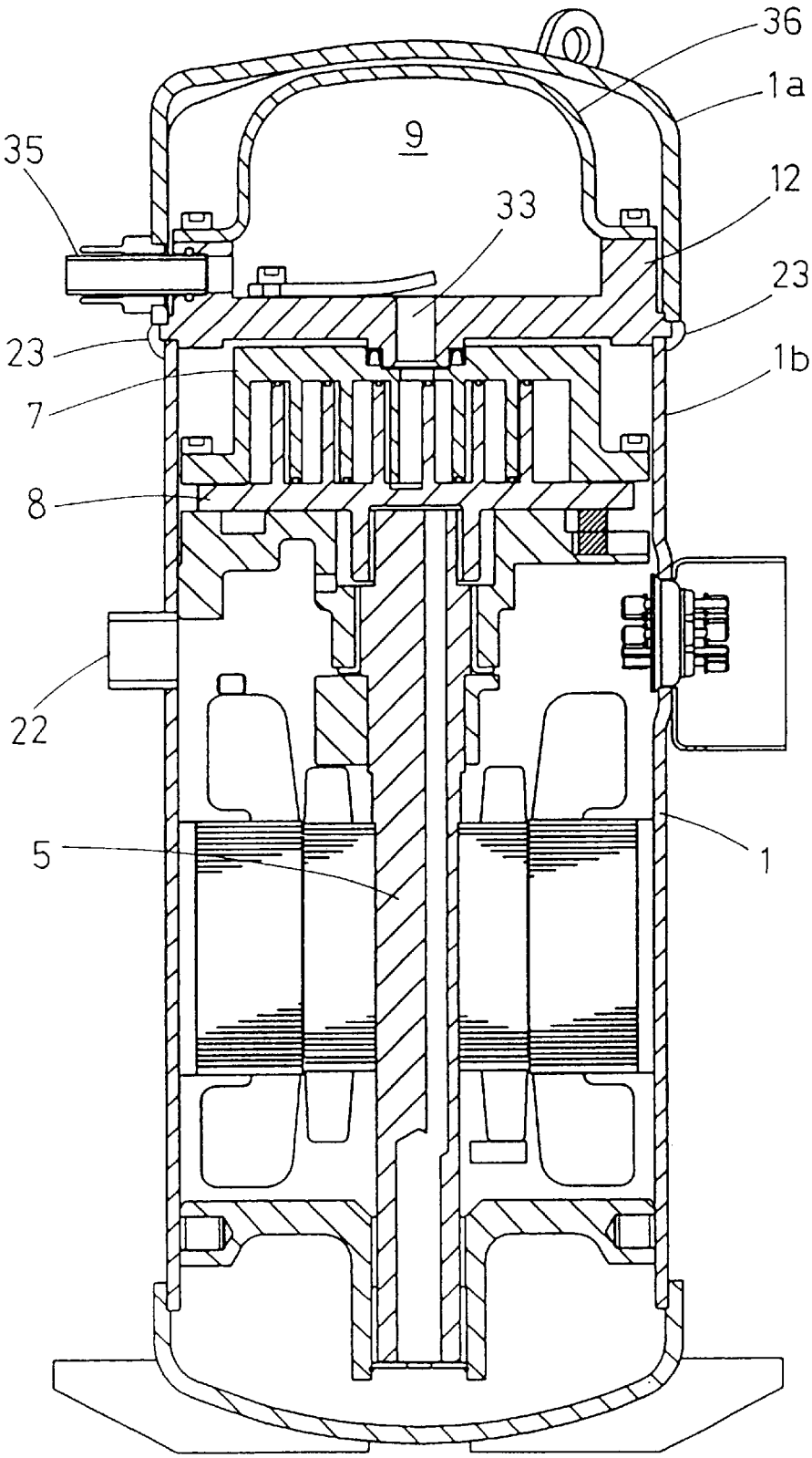
FIG. 2 is a sectional view of a scroll compressor illustrating another embodiment of the present invention.

FIG. 2 shows another embodiment. In this embodiment, the partition 12 is secured by welding to the joint between a vessel 1*a* and a vessel 1*b* making up the hermetically sealed vessel 1; reference numeral 23 denotes the welded section. The rest of the configuration of the embodiment is identical to the configuration shown in FIG. 1 and the description thereof will be omitted. This embodiment permits improved assemblability of the compressor and it obviates the need for fixing components for assembly.

Figure 3:
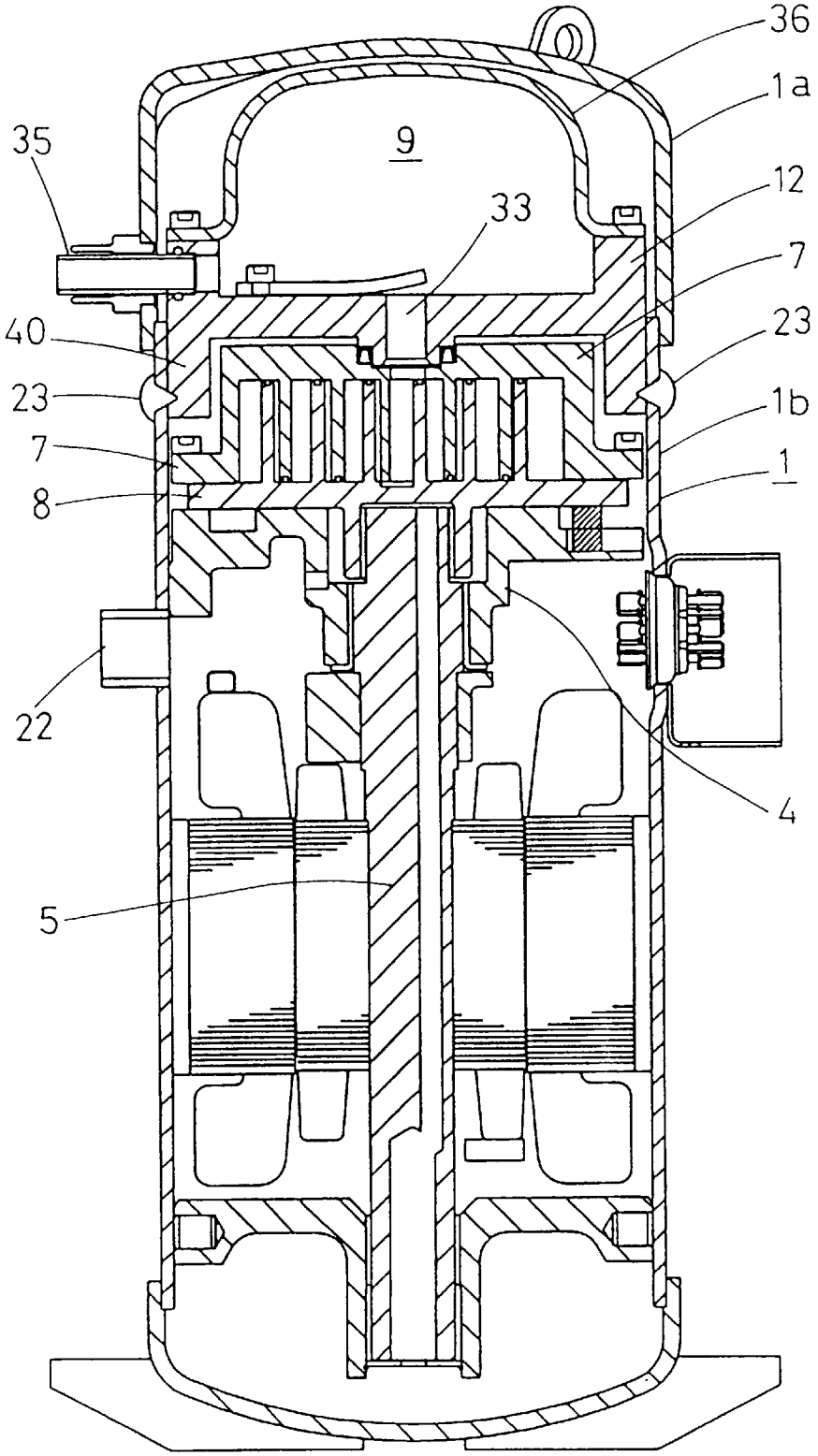
FIG. 3 is a sectional view of a scroll compressor illustrating a further embodiment of the present invention.

FIG. 3 shows still another embodiment. In this embodiment, a leg 40 is formed on the partition 12, and the leg 40 is fixed by welding to the vessel 1*b* constituting the hermetically sealed vessel 1, then the vessel 1*a* is attached to the vessel 1*b*; reference numeral 23 denotes the welded section. The rest of the configuration is identical to the configuration shown in FIG. 1 and the description there will be omitted. This embodiment also presents the same advantages as those of the embodiment shown in FIG. 2.

Figure 4:
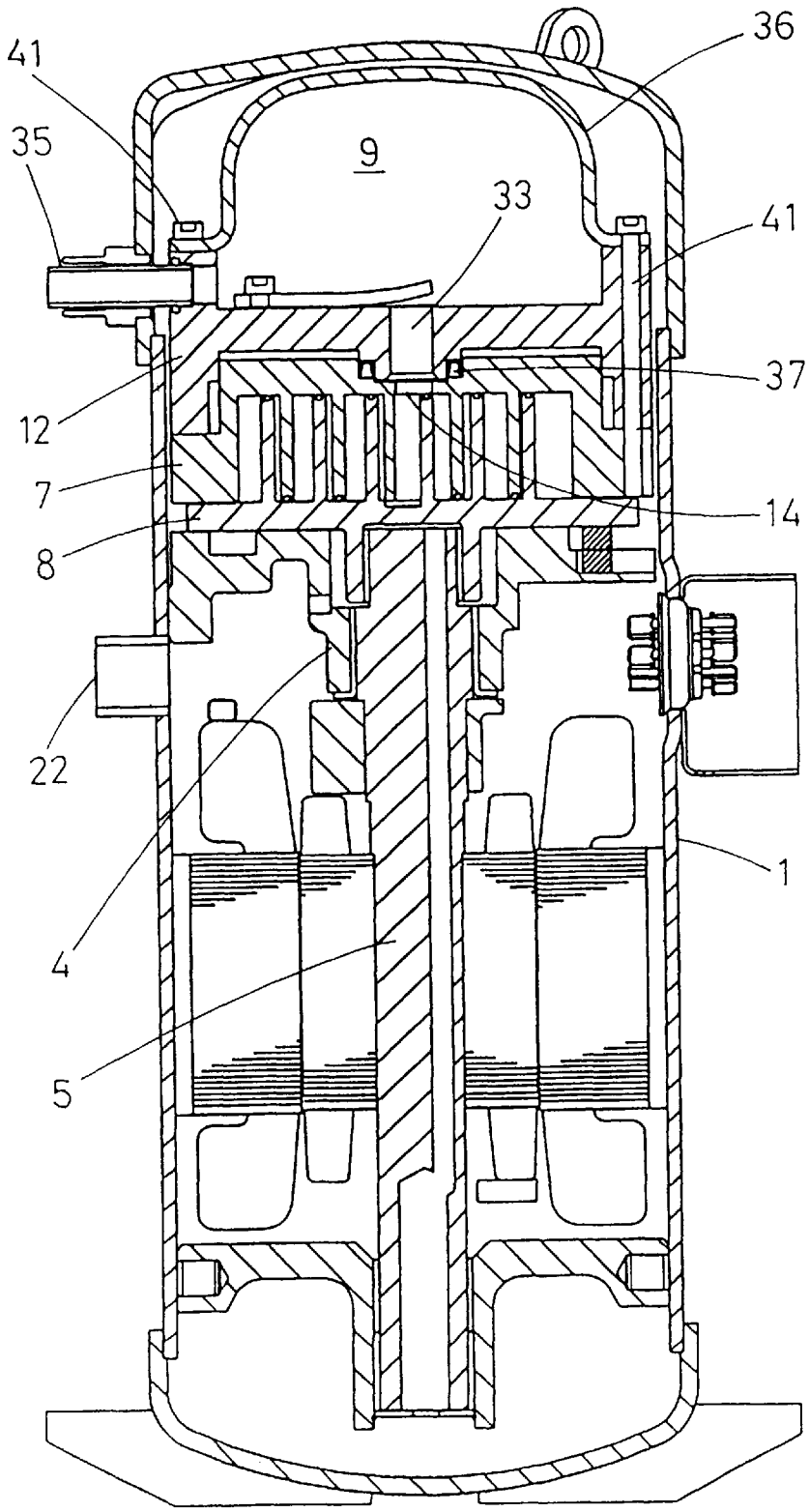
FIG. 4 is a sectional view of a scroll compressor illustrating yet another embodiment of the present invention.

FIG. 4 shows yet another embodiment. In this embodiment, the partition 12 is secured to the fixed scroll 7 by bolts 41. The partition 12 may alternatively be secured by the bolts 41 to a main frame 4 which supports the fixed scroll 7. This embodiment permits accurate positioning of the partition 12 in relation to the fixed scroll 7 and it also permits higher mounting accuracy of the sealing member 37 which connects the discharge hole 33 of the partition 12 with the discharge hole 14 of the fixed scroll 7, leading to further improved sealing performance.

Thus, according to the present invention, the covering member is attached to the partition to form the muffler and the discharge pipe is attached to the muffler; therefore, the high pressure muffler can be isolated from the fixed scroll. This makes it possible to prevent the deformation of the end plate of the fixed scroll while enabling the muffler to display the muffling effect at the same time.

Further, the hermetically sealed vessel is subjected only to the low pressure of intake gas; therefore, the strength required of the vessel can be easily realized. This means that the wall thickness of the vessel can be made thin and a general material can be employed for the vessel.

The partition is fixed to the hermetically sealed vessel by shrink fitting, press fitting, or welding to permit improved assemblability of the compressor and also to obviate the need for fixing components for assembly.

Alternatively, the partition is secured to the fixed scroll or the main frame which supports the fixed scroll by fasteners such as bolts. This enables accurate relative positioning of the partition and the fixed scroll. This permits higher mounting accuracy of the sealing member which connects the discharge hole of the partition with the discharge hole of the fixed scroll, thus leading to further improved sealing performance.

What is claimed is:

1. A scroll compressor comprising:

an hermetically sealed vessel having first and second ends;

a scroll compression element and an electric element housed in said hermetically sealed vessel spaced from said vessel first end; said scroll compression element comprising:

a fixed scroll having an end plate with a spiral wrap of an involute curve on the surface thereof;

a rocking scroll having an end plate with a spiral wrap of an involute curve on the surface thereof opposed to and engaged with said fixed scroll;

driving means for turning said rocking scroll in relation to said fixed scroll so that a plurality of compression spaces formed by said rocking scroll and said fixed scroll gradually become smaller from outside toward the inside, thereby implementing compression;

coupling means for revolving said rocking scroll with respect to said fixed scroll in such a manner that the rocking scroll does not rotate;

a partition between said fixed scroll end plate and said hermetically sealed vessel first end and fixed to said vessel to provide a space in said vessel sealable from said compression element;

a muffler in said space in said vessel formed by a member inside said vessel and attached to said partition;

a hole in said partition providing communication with a discharge hole in the end plate of said fixed scroll and said muffler to provide the compressed product from said fixed scroll to said muffler; and a discharge pipe attached to said muffler and in communication with the muffler interior, said discharge pipe extending through said vessel and providing communication to the exterior of said sealed vessel.

2. A scroll compressor according to claim 1, wherein said partition is fixed to the hermetically sealed vessel by shrink fitting, press fitting, or welding.

3. A scroll compressor according to claim 1, wherein said partition is secured to said fixed scroll or a main frame which supports said fixed scroll, by a fastener such as a bolt.

4. A scroll compressor as in claim 1 wherein said muffler comprises a covering member attached to said partition to form a muffler chamber which receives the high pressure product from said fixed scroll.

5. A scroll compressor as in claim 1 further comprising a valve covering said partition hole to open and close communication of the compressed product from said fixed scroll to said muffler.

* * * * *